US006920977B1

(12) United States Patent
VanSkiver et al.

(10) Patent No.: US 6,920,977 B1
(45) Date of Patent: Jul. 26, 2005

(54) BOW CASE

(75) Inventors: Ralph VanSkiver, Mansfield, TX (US); Scott A. Skurdalsvold, Arlington, TX (US); Christopher S. Sides, Grapevine, TX (US); Mike Harper, Fort Worth, TX (US)

(73) Assignee: Doskocil Manufacturing Company, Inc., Arlington, TX (US)

( * ) Notice: Subject to any disclaimer, the term of this patent is extended or adjusted under 35 U.S.C. 154(b) by 165 days.

(21) Appl. No.: 10/287,573

(22) Filed: Nov. 4, 2002

(51) Int. Cl.[7] ..... B65D 85/00

(52) U.S. Cl. ..... 206/315.11; 206/373; 43/54.1; D3/262

(58) Field of Search ..... 206/373, 372, 206/317, 349, 315.11, 314; 43/54.1; D3/262, D3/276, 260

(56) References Cited

U.S. PATENT DOCUMENTS 1,631,780 A * 6/1927 Zeitung ..... 217/9
2,825,444 A * 3/1958 Weir, Jr. ..... 206/543
5,079,863 A * 1/1992 Gillespie ..... 43/54.1
5,242,050 A * 9/1993 Billings ..... 206/315.11
5,344,339 A * 9/1994 Cheslock ..... 439/501
5,505,354 A * 4/1996 Hutton et al. ..... 224/196
6,237,767 B1 * 5/2001 Lee ..... 206/373
6,523,687 B2 * 2/2003 Ling ..... 206/378

OTHER PUBLICATIONS

Photograph—Doskocil XLT Box Case with Vertical Slot Arrow Support, Mar. 1993.
Photograph—Doskocil Deluxe Box Case with "Z" Slot Arrow Support, Jun. 2000.
Drawings—Plano Molding Company, Case for Archery Equipment, sold in 2000, as shown in U.S. Patent No. 6,390,294.

* cited by examiner

*Primary Examiner*—Jila M. Mohandesi
(74) *Attorney, Agent, or Firm*—Locke Liddell & Sapp LLP

(57) ABSTRACT

The present invention relates to a storage case for archery equipment and accessories. The storage case contains first and second case sections movable between an open and closed position. An accessory box is releasably connected to one of the case sections. When the case is in the closed position, the accessory box locked in position. A pair of arrow support members are disposed in one of the case sections to support a plurality of arrows therein. The arrow support members are angularly disposed to each other to prevent arrows from disengaging from the support members during transport of the case.

10 Claims, 7 Drawing Sheets

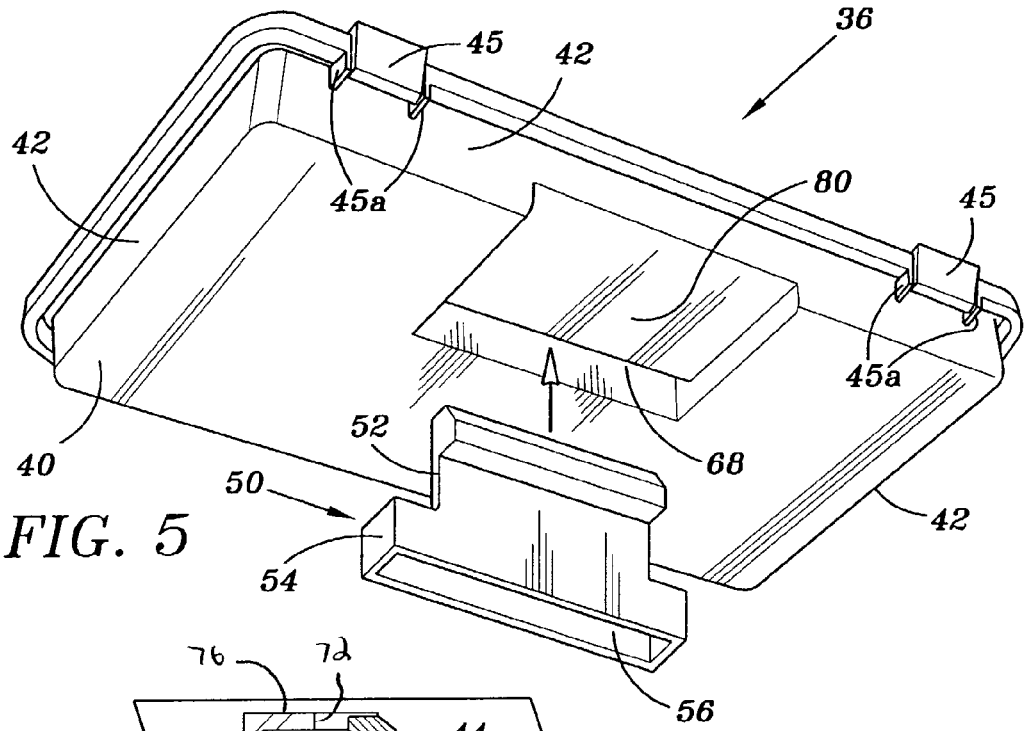
FIG. 5
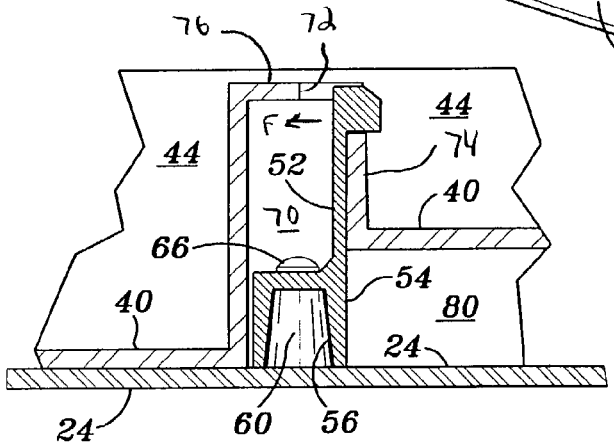
FIG. 6
FIG. 7
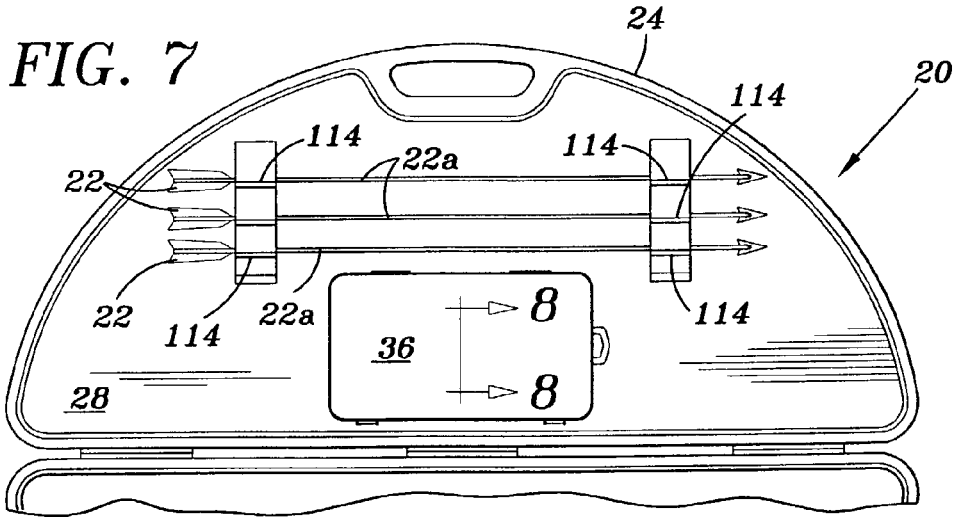

BOW CASE

TECHNICAL FIELD OF THE INVENTION

This invention relates to a storage case, and more particularly, to a case for storing archery accessories and having a removable accessory box connected thereto.

BACKGROUND OF THE INVENTION

Various storage cases exist to hold and protect archery equipment when transporting to and from hunting sites. However, because many hunters carry additional items such as arrow heads, knives, bow string, various tools, etc., additional storage containers or bags are often necessary. These additional items can be burdensome for the hunter to carry when traveling to and from hunting sites. This difficulty becomes greater when the hunting sites are located in remote areas. More importantly, in many instances, these items tend to be misplaced or even lost as they cannot be stored in a single and readily accessible location.

In order to reduce these problems, hunters oftentimes place these extra items or containers loosely inside the bow case. Thus, when the storage case is transported, these loosely stored items tend to shift. These moving items increase the risk of damage or destruction to the archery equipment that is also stored inside the storage case. Furthermore, when opening these storage cases, these loosely placed items tend to fall out from the case spilling onto the ground.

An additional problem with bow cases is that many arrow support members are ineffective at securely holding arrows during transport. Often during travel, the storage case will be tilted, rotated, bumped and even dropped, all of which can cause the arrows to disengage with the support structure. As a result, arrows will be damaged, and in many cases unusable. Furthermore, many cases can only store a limited number of arrows; as a result, hunters are often inconvenienced because they must carry additional storage accessories to transport these arrows.

Many current bow storage case designs present no way of effectively securing a quiver inside the storage case. Often hunters will place the quiver loosely inside the storage case. As a result, damage will occur to the quiver and the other items stored in the case. Furthermore, because quivers are of different sizes and shapes, many current storage case designs cannot effectively adapt to storing the differing sizes and shapes of quivers.

There is a need to provide a storage case so as to allow for convenient storage of a removable accessory box while also providing sufficient support for a large number or arrows and quivers of different dimensions.

SUMMARY OF THE INVENTION

The present invention relates to a storage case for archery equipment and accessories. The storage case contains a first and second section connected so as to move between an open and closed position. The case includes an interior storage compartment to hold archery equipment.

The present storage case includes an accessory box releasably connected inside the interior storage compartment. The accessory box is capable of storing tools and other accessories. The accessory box includes a top wall or lid, a bottom wall and sidewalls forming the accessory box storage area. A fastener mechanism releasably connects the accessory box to one of the case sections in a quick and easy manner. The fastener permits the user to insert and secure the accessory box inside the interior storage compartment so as to prevent the accessory box from shifting during transport.

The fastener mechanism preferably includes a latch having a top end and a bottom end. The latch bottom end is configured to attach to one of the case sections. The latch top end contains a flexible hook so as to securely fasten the accessory box inside the storage case. When connecting the accessory box to the storage case, a receiving chamber on the bottom wall of the accessory box is aligned with the hook. Once aligned, the receiving chamber is placed over the hook so that the hook will engage the chamber to securely fasten the accessory box to one of the case sections.

Alternatively, the fastener mechanism can include a pair of rails attached to one of the case sections. In this configuration, the accessory box slidably engages the rails so as to securely fasten the accessory box to the case section. In a similar configuration, the fastener mechanism can include a pair of flexible latches connected to one of the case sections. During attachment, the accessory box is inserted between the latches such that the latches deform to "snap-fit" the accessory box to the case section. This prevents the accessory box from moving.

In an additional alternate embodiment, the fastener mechanism can include a hook and pile fastener to securely fasten the accessory box to one of the case sections. Furthermore, in an additional alternate embodiment, the fastener mechanism is configured such that a post extends into the case interior area. In this configuration, the accessory box includes an aperture corresponding in size slightly larger than the size of the post so that when the post is aligned with the aperture, the post will extend through the aperture and a nut can securely fasten the accessory box to the case sections.

The present storage case is also configured to support and hold a plurality of arrows. Preferably, the arrows are supported by a pair of rectangular arrow support members having a top wall, a bottom wall, a pair of sidewalls, and a pair of end walls. The support members are preferably angularly disposed to each other. Each arrow support contains at least one vertical slot, extending substantially perpendicular from the top wall, and a at least one horizontal slot, extending generally perpendicularly from the vertical slot. Arrows are supported inside these slots by inserting the arrow inside the vertical slot until it is placed adjacent the desired horizontal slot. When in this position, the arrow is pushed into the horizontal slot so that it is securely retained therein.

BRIEF DESCRIPTION OF THE DRAWINGS

For a more complete understanding of the present invention and for further advantages thereof, reference is now made to the following Description of the Preferred Embodiments taken in conjunction with accompanying drawings in which:

FIG. 5 is a bottom perspective view of the accessory box and fastener mechanism.

FIG. 6 is a section view taken along the line 6—6 of FIG. of FIG. 4 illustrating the fastener mechanism.

FIG. 7 is a top view of a portion of the storage illustrating the arrow retainers aligned in parallel fashion.

DESCRIPTION OF THE PREFERRED EMBODIMENTS

Figure 2:
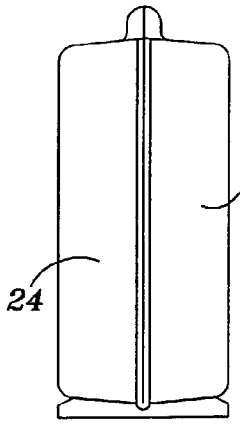
FIG. 2 is a end view of the storage case of FIG. 1.
Figure 1:
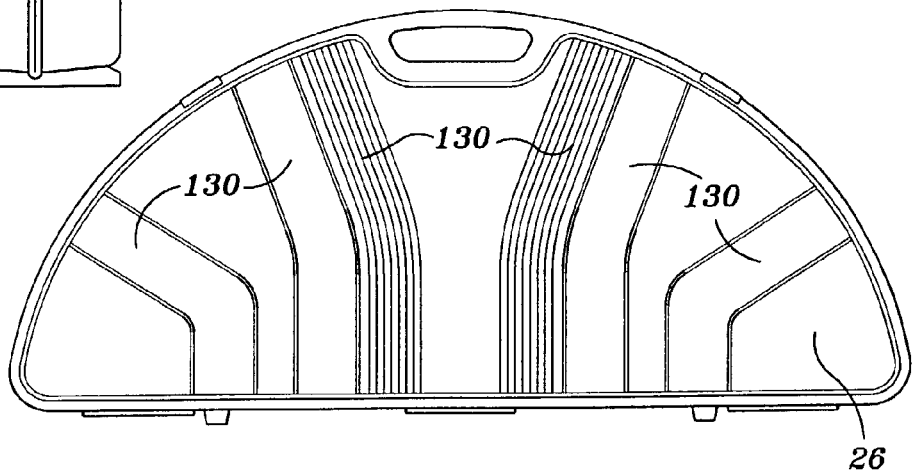
FIG. 1 is a front elevational view of the present storage case in the closed position.
Figure 3:
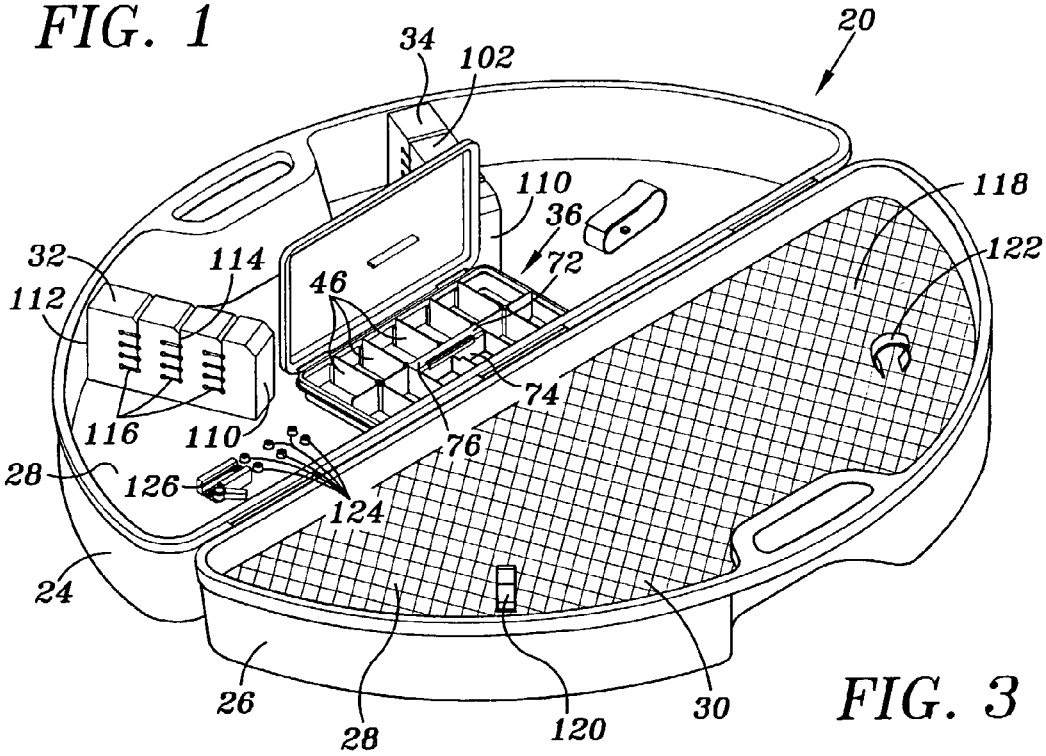
FIG. 3 is a front perspective view the storage case in the open position illustrating the first and second case sections, the arrow retainers and the accessory box.

Referring to FIGS. 1–3, storage case 20 can be seen. Storage case 20 is preferably configured so as to receive archery equipment, such as a bow and arrows (not shown). Storage case 20 contains a first case section 24 and a second case section 26 operable between a closed position (FIGS. 1 and 2) and an open position (FIG. 3). First and second case sections 24 and 26 form an interior storage area 28. Storage case 20 includes a bow storage area 30 in section 26, a pair of arrow support members 32 and 34 to support a plurality arrows 22 (FIG. 7), and a removable accessory box 36 to store items such as stabilizers, tools, nocks, fletching, glue, bow string, wax, point and broadheads, site pins, limb savers, peeps, silencers or any other desired item in section 24.

Figure 4:
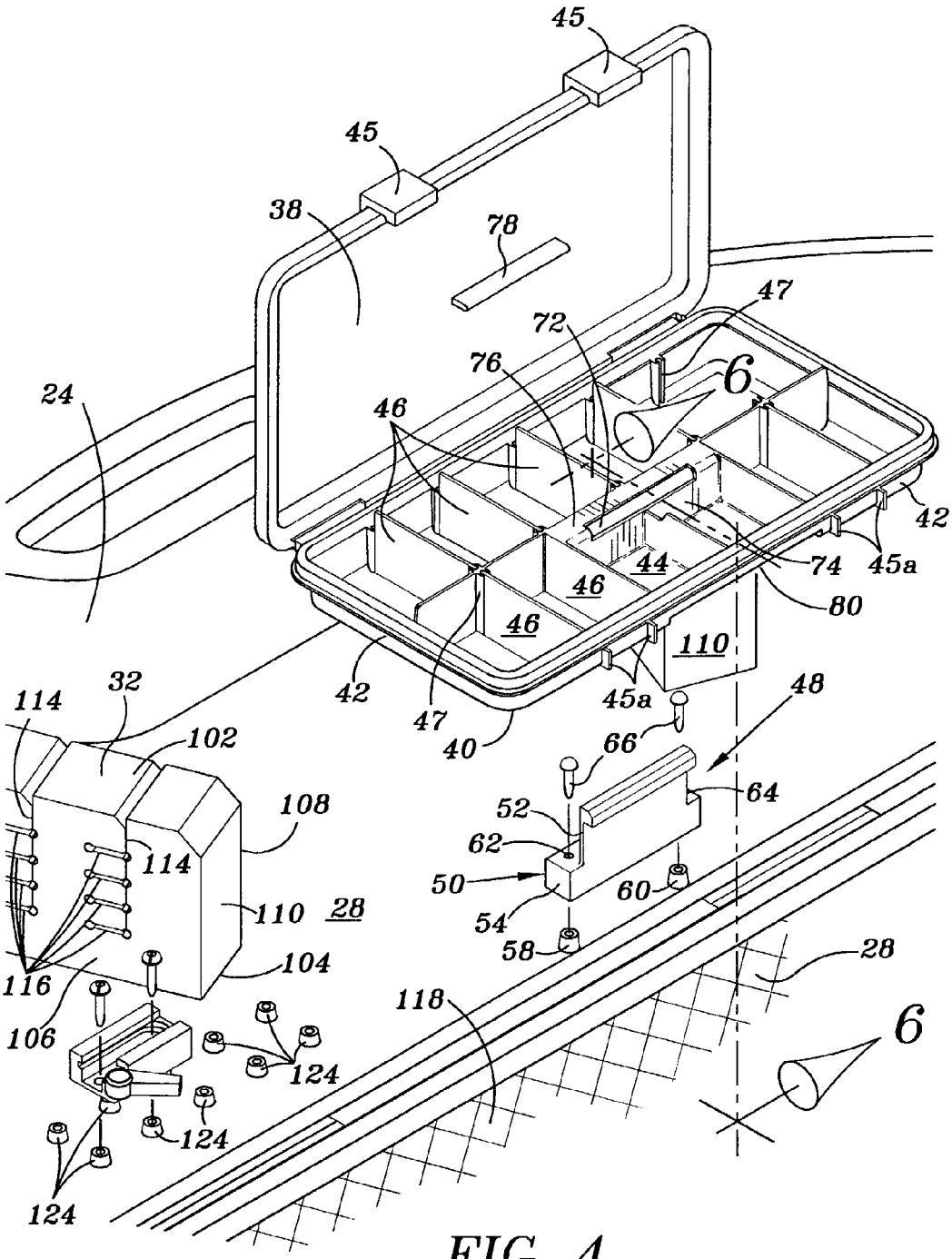
FIG. 4 is an exploded view of a portion of the storage case and accessory box of FIG. 3.

As seen in FIG. 4, accessory box 36 is defined by a top wall or lid 38, a bottom wall 40 and sidewalls 42 to form an accessory storage area 44. Accessory storage area 44 can include removable dividers 46 disposed inside grooves 47 to reduce or increase the size of each individual compartment within storage area 44. Lid 38 is operable between an open and closed position to allow access inside storage area 44 and is locked by latches 45 which engage members 45*a*.

Accessory box 36 is sized such that box 36 is securely attached to storage case 20 by a fastener 48. Preferably, fastener 48 includes a latch 50 to connect accessory box 36 to case 20. Latch 50 contains a flexible hook member 52 integrally molded to a base member 54. Base member 54 contains a hollow chamber 56 (FIG. 5) to receive bosses 58 and 60.

Base member 54 connects to first case section 24 by aligning base member apertures 62 and 64 with bosses 58 and 60. Once aligned, hollow chamber 56 is placed over bosses 58 and 60 such that base apertures 62 and 64 are aligned with bosses 58 and 60. Screws 66 are used to secure latch 50 to case 20.

Figure 8:
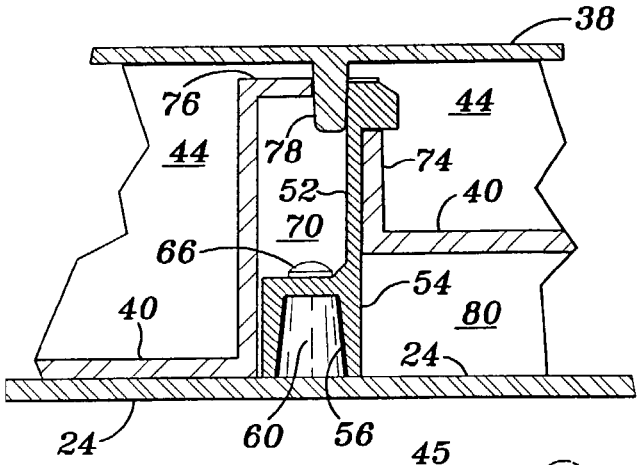
FIG. 8 is a section view taken along the line 8—8 of FIG. 7.

Referring to FIG. 5, when accessory box 36 is attached to case 20, latch 50 is aligned with aperture 68 located in accessory box 36 bottom wall 40. Hook 52 is then inserted through accessory box aperture 68 and into a chamber 70 (FIG. 6). As best seen in FIG. 6, latch 50 extends into chamber 70 until hook 52 is inserted through an opening 72, defined by chamber front wall 74 and top wall 76. While inserting latch 50 into chamber 70, hook 52 deflects slightly and slidably engages front wall 74 until the hook is inserted through opening 72. While in this position, hook 52 snaps above the top portion of front wall 74 and secures accessory box 36 to case 20. Referring to FIG. 8, when lid 38 is closed, a tab 78, mounted on the underside of accessory box lid 38, prevents hook 52 from deflecting. Tab 78 reduces the risk of accessory box 36 separating from latch 50 and potentially sliding inside interior storage area 28 while being transported.

In order to detach accessory box 36 from case 20, lid 38 is opened so as to remove tab 78 from opening 72. Once removed, the user can apply a slight force to hook 52 in the direction of arrow F (FIG. 6) so as to deflect the hook 52 away from chamber front wall 74. After a sufficient force has been provided to separate hook 52 from wall 74, the user can remove accessory box 36 from case interior 28 by lifting the box away from latch 50. As best seen in FIG. 5, a recessed area 80, located in accessory box bottom wall 40, allows the user to easily grasp and lift accessory box 36 from case interior 28.

Figure 9:
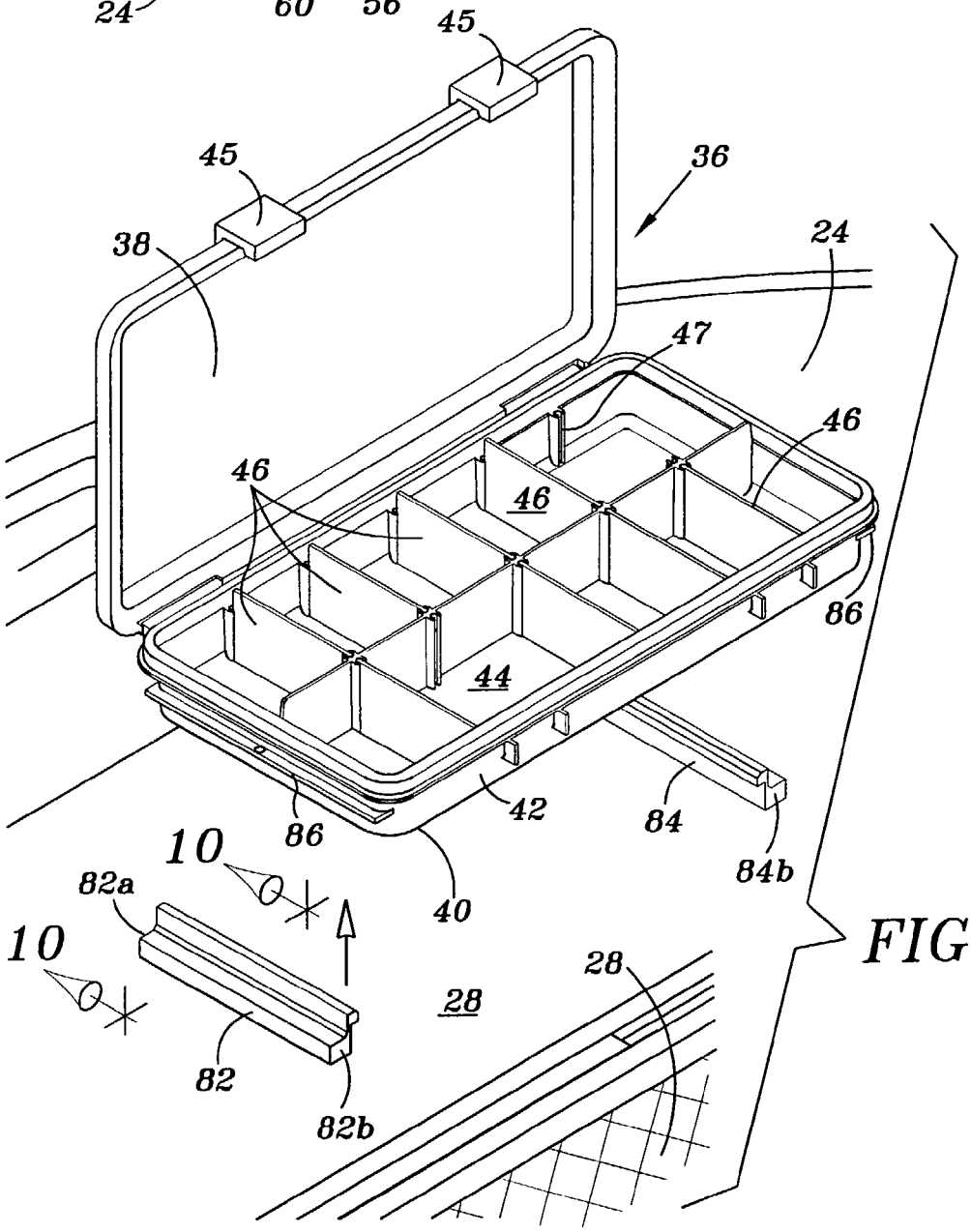
FIG. 9 is an exploded view of a portion of the storage case and accessory box showing an alternate embodiment of the fastener mechanism having a pair of rails.
Figure 10A:
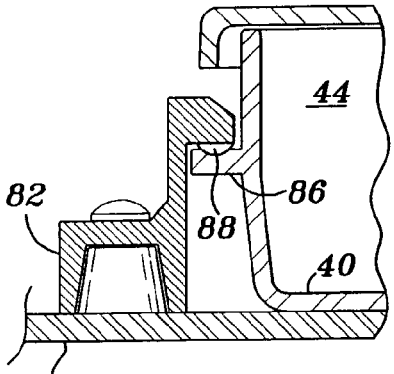
FIG. 10*a* is a section view taken along the line 10—10 of FIG. 9.

Other fastener mechanisms 48 can be used to secure accessory box 36 inside case interior 28. FIG. 9 illustrates fastener mechanism including a pair of parallel rails 82 and 84 attached to first case section 24. In this embodiment, accessory box 36 can be removed or inserted without lid 38 being open. As seen in FIGS. 9 and 10*a*, accessory box ribs 86 are configured to slidably engage rails 82 and 84. While only the left sidewall 42 of accessory box 36 is illustrated in FIG. 10*a*, the same rib configuration extends from the right sidewall 42 of accessory box 36. Referring to FIG. 9, when securing accessory box 36 to first case section 24, accessory box ribs 86 are placed adjacent and aligned with each rail first end 82*a*. Once aligned, accessory box 36 is moved toward rail second ends 82*b* and 84*b* until accessory box 36 is adjacent rail second ends 82*b* and 84*b*. A locking mechanism, such as a detent 88 (FIG. 10*a*), is used to prevent further sliding of accessory box while secured to rails 82 and 84. When detaching accessory box 36 from case 20, a slight force is applied to the accessory box to overcome the locking force from the detent 88. Accessory box 36 is then slid toward rail first end 82*a* until the accessory box no longer engages rails 82 and 84.

Figure 10B:
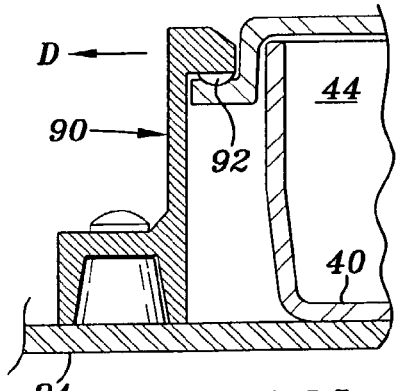
FIG. 10*b* is a section view of an additional embodiment illustrating the latch engaged with the accessory box.

As seen in FIG. 10*b*, an alternate fastener configuration includes flexible latches 90 attached to first case section 24. While only one latch 90 can be seen, it should be realized by one of ordinary skill that a latch 90 is mounted adjacent to both the left and right sides of accessory box 36 in case section 24. In order to secure accessory box 36 to case 20, latches 90 are deflected in the direction of arrow D to provide sufficient clearance for the accessory box 36 to be inserted. Once accessory box 36 is placed between latches 90 and is supported by first case section 24, latches 90 are then released so as to engage or "snap fit" accessory box 36 to case 20. Preferably, a detent 92 prevents accessory box 36 from sliding while engaging latches 90. In order to remove accessory box 36, latches 90 are deflected away from accessory box 36 in the direction of arrow D so that accessory box 36 can be removed.

Figure 11:
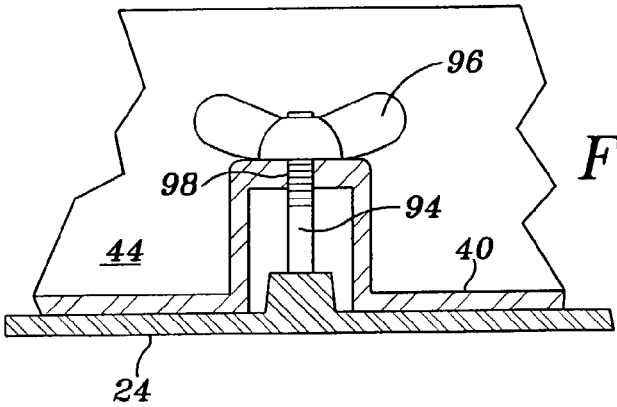
FIG. 11 is a section view of an alternate embodiment of the fastener mechanism having a nut and bolt.

FIG. 11 illustrates an additional fastener configuration including a post 94 and a nut 96. To attach accessory box 36 to case 20, aperture 98 is co-axially aligned with post 94. Accessory box 36 is positioned such that post 94 extends through aperture 98. In this position, a nut 96 can be secured to post 94 to fasten accessory box 36 to case 20.

Figure 12:
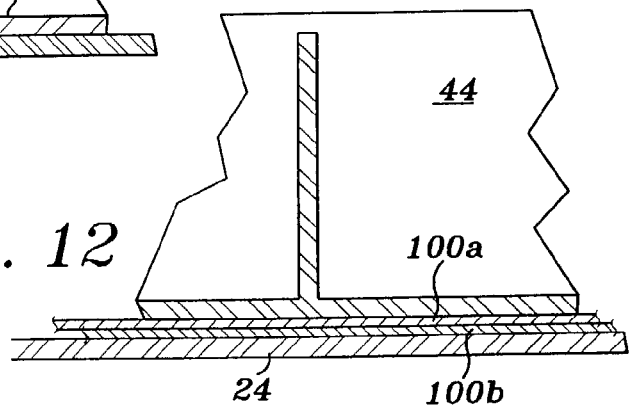
FIG. 12 is a section view of an alternate embodiment of the fastener mechanism illustrating the use of a hook and pile fastener.

Referring to FIG. 12, an additional fastener mechanism can be seen. The fastener mechanism includes a hook 100*a* and pile fastener 100*b* attached to accessory box bottom wall 40 and accessory box 36 respectively, such that when accessory box 36 is inserted inside storage case interior area 28, box 36 will be secured therein.

Figure 13:
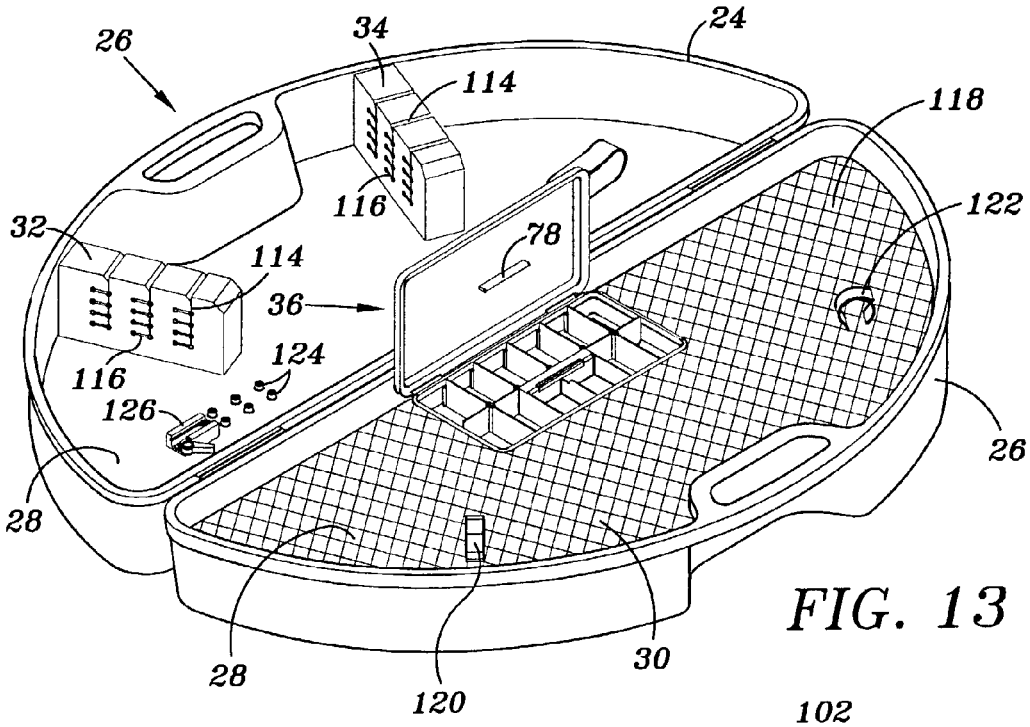
FIG. 13 is a front perspective view of the present storage case illustrating the accessory box optionally mounted to the second case section.

Storage case 20 can be configured to secure accessory box 36 on either the first case section 24, as seen in FIGS. 3, 4 and 9 or on the second case section 26, as seen in FIG. 13. If secured to second case section 26, latch 50 can be easily removed and placed on second case section 26, or, an additional latch 50 can be secured to second case section 26.

Figure 14:
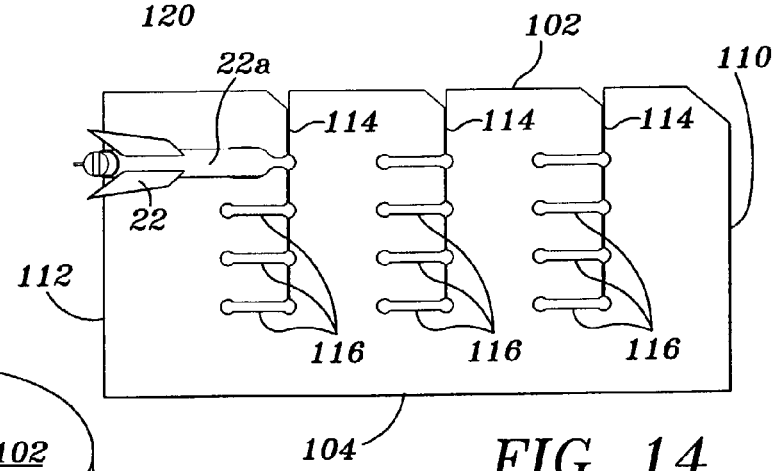
FIG. 14 is a side elevation view of the arrow support member of FIG. 3.

As seen in FIGS. 3, 7, 13 and 17, arrow support members 32 and 34 are configured to receive and hold multiple arrows 22 inside storage case 20. In a preferred embodiment (FIG. 14), arrow support members 32 and 34 are defined by a top wall 102, a bottom wall 104, a pair of sidewalls 106 and 108 and a pair of end walls 110 and 112. As seen in FIGS. 4 and 14, arrow support members 32 and 34 further include at least one vertical slot 114 extending between sidewalls 106 and 108 and downward from top wall 102 towards bottom wall 104. At least one horizontal slot 116 extends substantially perpendicular from and intersects vertical slot 114 so as to hold and support an arrow 22. As seen in FIG. 14, each arrow support member 32, 34 can include multiple vertical slots 114 and horizontal slots 116 to support a plurality of arrows 22. In securing arrow 22 to support member 32 and 34, the arrow shaft 22*a* is inserted inside vertical slot 114 and placed toward bottom wall 104. As arrow shaft 22*a* is placed adjacent the desired horizontal slot 116, shaft 22*a* can be inserted into the horizontal slot 116 so as to prevent the arrow from disengaging the support member 32, 34. When inserted inside horizontal slot 116, the perimeter of shaft 22*a* inside slot 116 is surrounded to securely retain arrow 22. Arrow support members 32 and 34 are preferably fabricated from a foam-like material or similar compressible material.

Figure 17:
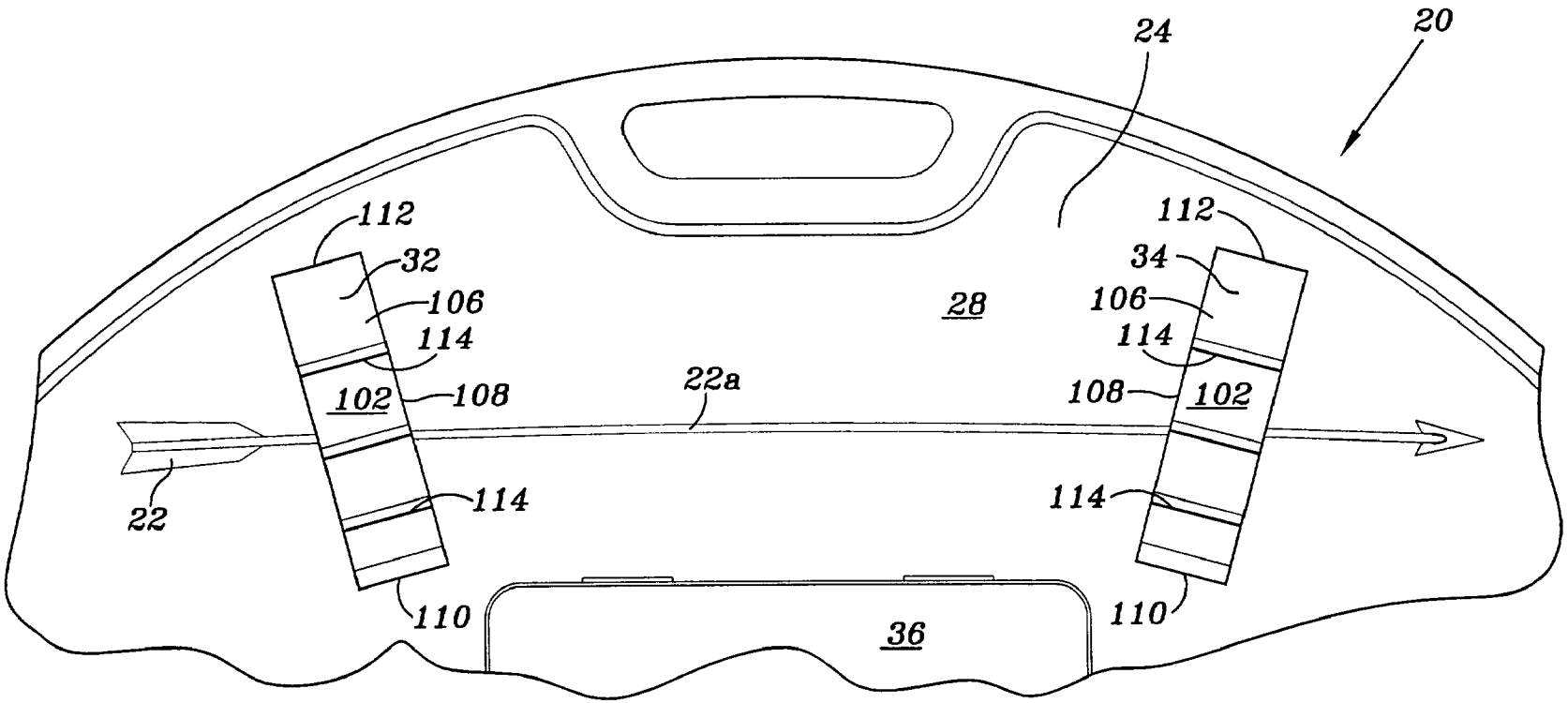
FIG. 17 is a top view of the first case section with arrow support members being angularly disposed to each other having an arrow supported thereon.

Referring to FIGS. 13 and 17, arrow support members 32 and 34 are spaced apart and secured to first case section 24. Support members 32 and 34 are preferably angularly disposed with respect to each other such that slots 114 and 116 on member 32 are also angularly disposed with respect to slots 114 and 116 on member 34. Thus, when storing arrows 22 inside storage case 20, the offset angle of slots 114 and 116 on members 32 and 34 supply a slight tension force to arrows 22 to securely fasten arrows 22 while being stored inside case 20. This tension force prevents arrows 22 from loosening during transport of case 20.

Figure 15:
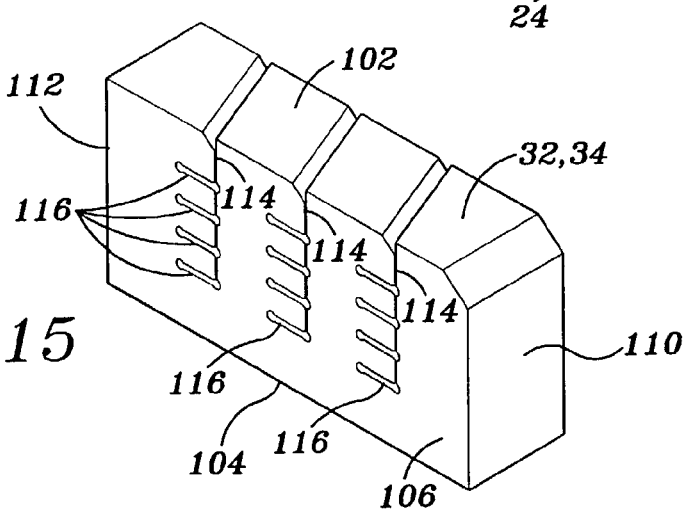
FIG. 15 is perspective view of an additional embodiment of the arrow support member on FIG. 3 illustrating the slots angularly disposed.
Figure 16:
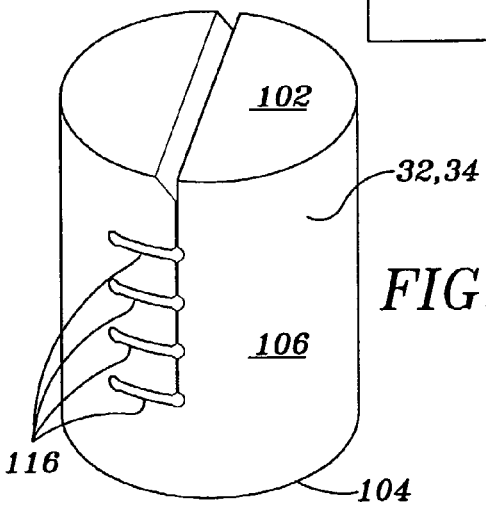
FIG. 16 is a perspective view of an alternate embodiment of the arrow support member.

Alternatively, as seen in FIG. 7, arrow support members 32 and 34 can be mounted parallel to each other. Furthermore, while in this mounting configuration, slots 114 can be angularly disposed with respect to sidewalls 106 and 108, as best seen on support member 32, 34 illustrated in FIG. 15. This angle of slot 114 provides sufficient tension force on arrows 22 so as to securely fasten arrows 22 while being stored inside case 20. Furthermore, members 32 and 34 can be shaped in any number of different configurations, such as a cylinder shown in FIG. 16, by way of example.

As seen in FIG. 3, bow storage area 30 contains a foam support cushion 118 so as to provide a soft support for a bow (not shown) when inserted inside bow storage area 30. The bow is secured inside bow storage area 30 by loops 120 and 122.

FIG. 4 illustrates a series of mounting protrusions 124 for a quiver mount 126. Because quivers are manufactured by a variety of manufacturers, many quivers vary in size and shape. As a result, a series of mounting protrusions 124 are provided such that the quiver release mechanism can be attached to accommodate different sized quivers.

Referring to FIG. 2, storage case 20 contains support ribs 130 along the exterior of case 20 so as to provide additional strength to case 20. This strength is especially useful during storage and transport.

Other alteration and modification of the invention will likewise become apparent to those of ordinary skill in the art upon reading the present disclosure, and it is intended that the scope of the invention disclosed herein be limited only by the broadest interpretation of the appended claims to which the inventors are legally entitled.

We claim:

1. A storage case comprising:

first and second case sections connected to move between an open and closed position, said case sections defining an interior compartment in the closed position;

an accessory box releasably connected to one of said case sections and being locked to said one of said sections within said interior compartment when said sections are in the closed position and removable from said interior compartment when said sections are in the open position, said accessory box including a hollow chamber having a top wall and side wall, said top wall having an aperture and said side wall having an aperture;

a flexible latch having a top end and a bottom end, said top end including a hook extending into said interior compartment and said bottom end being attached to one of said case sections;

said latch being selectively insertable into said accessory box hollow chamber, such that said latch hook passes through said chamber side wall aperture to engage said chamber side wall to thereby selectively fasten said accessory box to said one of said case sections; and such that when said hook is deflected from said chamber side wall and withdrawn from said side wall aperture to thereby position said latch hook within said chamber, said accessory box is thereby unfastened from said one of said case sections to remove said accessory box from said interior compartment.

2. The storage case of claim 1 further including an arrow retainer comprising first and second support members attached to one of said sections and extending into said compartment, said support members being angularly disposed to each other and including a slot adapted to receive an arrow.

3. The storage case of claim 2 wherein said first and second support members include a top wall, a bottom wall and sidewalls, said slot being disposed generally perpendicular to said top and bottom walls and extending between said sidewalls.

4. The storage case of claim 2 wherein said first and second support members include a top wall, a bottom wall and sidewalls, said slot being disposed generally parallel to said top and bottom walls and extending between said sidewalls.

5. The storage case of claim 1 further including an arrow retainer comprising:

first and second support members attached to one of said sections and extending into said compartment, wherein each of said support members includes a top wall, a bottom wall and side walls; and said members each include a first slot disposed generally perpendicular to said top and bottom walls and a second slot disposed generally perpendicular to and intersecting said first slot, said second slot being adapted to receive an arrow.

6. The storage case of claim 5 wherein said support members are angularly disposed to each other.

7. The storage case of claim 5 wherein said first slot is angularly disposed to said sidewalls.

8. The storage case of claim 1 further including an arrow retainer comprising:

first and second support members attached to one of said sections and extending into said compartment; and said support members each including a slot adapted to receive an arrow, said first support member slot being angularly disposed to said second support member slot.

9. The storage case of claim 8 wherein said first and second support members are cylindrical.

10. The storage case of claim 1 wherein said accessory box includes a lid moveable between an open and closed position, said lid having a tab, said tab being disposed through said chamber top wall aperture to engage said hook when said lid is in said closed position and said accessory box is fastened to said one of said case sections.

* * * * *